US006502399B2

(12) United States Patent
Mandai et al.

(10) Patent No.: US 6,502,399 B2
(45) Date of Patent: Jan. 7, 2003

(54) THREE-DIMENSIONAL SWIRLER IN A GAS TURBINE COMBUSTOR

(75) Inventors: Shigemi Mandai, Takasago (JP); Masataka Ohta, Takasago (JP); Mitsuru Inada, Takasago (JP); Shinji Akamatsu, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 9 days.

(21) Appl. No.: 09/794,134

(22) Filed: Feb. 28, 2001

(65) Prior Publication Data

US 2001/0023590 A1 Sep. 27, 2001

Related U.S. Application Data

(63) Continuation-in-part of application No. 09/145,498, filed on Sep. 2, 1998, now abandoned.

(30) Foreign Application Priority Data

Sep. 10, 1997 (JP) ..... 9-245477

(51) Int. Cl.[7] ..... F23R 3/14
(52) U.S. Cl. ..... 60/748; 60/747
(58) Field of Search ..... 60/748, 746, 747

(56) References Cited

U.S. PATENT DOCUMENTS

| | | | | |
|---|---|---|---|---|
| 1,931,692 A | | 10/1933 | Good | |
| 2,798,661 A | | 7/1957 | Willenbrock, Jr. et al. | |
| 2,803,296 A | | 8/1957 | Young | |
| 2,898,874 A | | 8/1959 | Crewdson, Jr. | |
| 3,904,119 A | | 9/1975 | Watkins | |
| 3,915,387 A | | 10/1975 | Caruel et al. | |
| 4,221,558 A | | 9/1980 | Santisi | |
| 4,600,377 A | | 7/1986 | Musil | |
| 4,695,225 A | | 9/1987 | Hellat et al. | |
| 5,094,610 A | | 3/1992 | Mandai et al. | |
| 5,186,607 A | | 2/1993 | Yang et al. | |
| 5,618,173 A | | 4/1997 | Rühl et al. | |
| 5,899,075 A | * | 5/1999 | Dean et al. | 60/748 |
| 5,966,937 A | | 10/1999 | Graves | |

FOREIGN PATENT DOCUMENTS

| | | |
|---|---|---|
| EP | 0 397 046 | 11/1990 |
| WO | 89/06307 | 7/1989 |

* cited by examiner

*Primary Examiner*—Ted Kim
(74) *Attorney, Agent, or Firm*—Wenderoth, Lind & Ponack, L.L.P.

(57) ABSTRACT

A pre-mixture forming swirler in a gas turbine pre-mixed flame type low $NO_x$ combustor is improved so as to accelerate mixing of fuel and air and to prevent the occurrence of flame stagnation and burning of components. In particular, a three-dimensional swirler is constructed such that each swirler vane is twisted from a hub side thereof to a tip side so that a fitting angle of the tip side relative to a center axis of a fuel nozzle is larger than an angle of the hub side. Thereby, while the angle of the hub side is set smaller so that flame stagnation and burning of components resulted therefrom may be prevented from occurring, the angle of the tip side may be selected so that the shearing flow necessary for appropriate mixing of fuel and air is obtained. Thus, favorable pre-mixing is achieved, life deterioration due to burning, etc., is prevented and combustion efficiency is enhanced.

1 Claim, 3 Drawing Sheets

THREE-DIMENSIONAL SWIRLER IN A GAS TURBINE COMBUSTOR

This is continuation-in-part (CIP) of Ser. No. 09/145,498, filed Sep. 2, 1998, now abandoned.

BACKGROUND OF THE INVENTION

1. Field of the Invention

The present invention relates to a swirler for forming a premixture in a pre-mixed flame type low $NO_x$ combustor of a gas turbine.

2. Description of the Prior Art

The above-mentioned type of combustor, which is known in the prior art, will be outlined below with reference to FIGS. 2 to 5. FIG. 4 is an entire constructional view of one example of a prior art pre-mixed flame type low $NO_x$ combustor and FIG. 5 is a cross sectional view of a main fuel nozzle as part of the combustor of FIG. 4.

What is called a fuel supply nozzle for supplying fuel and air or a mixture thereof into a combustor consists of a pilot fuel nozzle 204 for forming a flame portion in a cross sectional center of the combustor, and a plurality of main fuel nozzles 202. Each of the main fuel nozzles has an outer casing 206. The main fuel nozzles are arranged so as to surround the pilot fuel nozzle 204 for forming a pre-mixed gas of fuel and air, etc.

In an upstream portion of each of the main fuel nozzles 202, there is provided a main swirler 201 surrounding the main fuel nozzle 202 and extending to a position adjacent the outer casing 206.

Also, in a wall of the body of the main fuel nozzle 202 on a downstream side of the main swirler 201, there are bored a plurality of nozzle holes 205 along a circumferential direction of the main fuel nozzle 202.

In the prior art combustor constructed as above, the main swirlers 201 are provided in plural units and a pilot swirler 203 in a single unit at a center of the combustor, and combustion air is supplied through the plurality of main swirlers 201 and the pilot swirler 203 and fuel is supplied from the plurality of main fuel nozzles 202 and the pilot fuel nozzle 204.

In the main fuel nozzle 202, as shown in FIG. 5, the fuel is injected from the nozzle holes 205 bored in the wall of body of the main fuel nozzle 202 and is mixed with the air flowing on an outer periphery of the nozzle via the main swirler 201 to form a pre-mixed gas.

When the air flows through the main swirler 201, it is given a swirling angle by the main swirler 201 and this angle is governed by a fitting angle in which a swirler vane is fitted to a hub portion thereof relative to a center axis of the fuel nozzle.

In the prior art swirler, while there is seen such an example that the fitting angle of the swirler vane is changed and adjusted for changing the swirling angle, the swirler in actual use remains such that when the fitting angle of the swirler vane to the hub portion (hub portion fitting angle) is changed and adjusted, that hub portion fitting angle is maintained the same as far as to a tip portion of the swirler vane and there is seen no more example of angle change.

FIGS. 2 and 3 show concrete examples of changing the hub portion fitting angle of the swirler vane.

That is, as shown in FIGS. 2(*a*) and 2(*b*) one example is that the hub portion fitting angle of a swirler vane 201*a* relative to a center axis C of the main fuel nozzle 202 is 25°.

In particular, FIG. 2(*a*) is a view showing an arrangement of a swirler relative to the fuel nozzle and FIG. 2(*b*) is a view showing an arrangement of the swirler vanes.

Also, another example is that the hub portion fitting angle of a swirler vane 201*b* relative to the center axis C of the main fuel nozzle 202 is 45°, as shown in FIGS. 3(*a*)–3(*b*). In particular, FIG. 3(*a*) is a view showing an arrangement of a swirler relative to the fuel nozzle, and FIG. 3(*b*) is a view showing an arrangement of the swirler vanes.

In either of FIGS. 2 and 3, air A supplied from upstream runs into the swirler vanes 201*a* or 201*b* to form an outward swirling flow and fuel F of natural gas and the like is supplied into this swirling flow of air via nozzle holes 205 of the main fuel nozzle 202 to form a pre-mixture of the fuel F and the air A.

In the prior art swirler in which the hub portion fitting angle of the swirler vane 201*b* shown in FIG. 3 is 45°, because the angle is as large as 45°, the shearing flow of the air A is strong, so that mixing of the fuel F and the air A is accelerated very favorably.

However, due to the strong shearing flow, there is formed a large stagnation point P at a tip portion of the main fuel nozzle 202, as shown by a hatched portion in FIG. 3(*a*), and if a back fire phenomenon once occurs, flame stagnates at the stagnation point P, so that there arises a problem that the main fuel nozzle 202 is apt to burn.

On the other hand, in the prior art swirler in which the hub portion fitting angle of the swirler vane 201*a* shown in FIG. 2 is 25°, because the angle of 25° is comparatively small, shearing flow of the air A is not so strong and the stagnation point P which is formed at the tip portion of the main fuel nozzle 202, as shown by a hatched portion in FIG. 2(*a*), is small, hence even if a back fire phenomenon occurs, flame does not specifically stagnate at the stagnation point.

However, this effect is obtained by the shearing flow of the air A which is not very strong and as a result, mixing of the fuel F and the air A, which is a function required for a pre-mixed type combustor, becomes worse, as clearly understood when compared with the swirler of FIG. 3 in which the hub portion fitting angle of the swirler vane 201*b* is 45° and there is a problem of narrow range of condition within which a low $NO_x$ combustion is attained.

SUMMARY OF THE INVENTION

It is therefore an object of the present invention to provide a combustor with a swirler which is able to accelerate mixing of fuel and air as well as to reduce a stagnation point formed at a tip portion of a main fuel nozzle to thereby prevent the occurrence of flame stagnation and burning of components so as to solve the problems in the prior art.

In order to attain this object, the present invention provides a three-dimensional swirler characterized in that a swirler vane fitted around a fuel nozzle is twisted from a hub side thereof to a tip side thereof so that a fitting angle of the tip side relative to a center axis of the fuel nozzle is larger than that of the hub side.

The present invention is directed to the pre-mixture-forming swirler in a pre-mixed flame type combustor of a gas turbine. The swirler vanes can accelerate the mixing of fuel and air as well as stabilize the flames and prevent the occurrence of burning damage of the nozzles. The swirler is constructed in a three-dimensional structure having the swirler vanes twisted from the hub side to the tip side, wherein the tip side has the fitting angle that is larger than the hub side with respect to the central axis of the fuel nozzle. That is, the fitting angle on the hub side is 25° or less so that the flame stagnation point formed in the tip portion of the main nozzle may be made smaller and the fitting angle on the tip side is 25° or more so that fuel and air may be mixed together with the shear flow thereof being strengthened. Further, the preferred angle on the hub side is 25° and the preferred angle on the tip side is 45°.

Furthermore, the combustor comprises the pilot fuel nozzle for forming a flame portion in the central portion of the combustor and the main fuel nozzles, each nozzle including a cylindrical outer casing, are arranged so as to surround the pilot fuel nozzle for forming a pre-mixed gas of fuel and air. The swirler is arranged so as to surround each of the main fuel nozzles and extend to the position of the outer casing. Each of the main fuel nozzles further comprises the nozzles holes bored therein along the circumferential direction of the main fuel nozzle downstream of the swirler. In such a combustor, in the prior art case, the swirler vane angle has been the same at both the tip side and the hub side, so that if the mixing of fuel and air is to be improved, that is, if the vane angle is made larger, a stagnation portion is formed at the tip end portion of the main fuel nozzle and, thereby if a back fire phenomenon occurs, the flame stagnates at the stagnation portion and there arises a problem in that the main fuel nozzle is apt to burn. On the other hand, if the vane angle is made smaller for the purpose of solving the burning problem of the main fuel nozzle, then the mixing of fuel and air becomes insufficient. The present invention solves these mutually contradictory problems at one time. In the present invention, the swirler is made in the three-dimensional structure such that the vane angles at the hub side and the tip side are different, that is, the angle on the hub side is 25° or less in view of the burning problem and the angle on the tip side is 25° or more in view of the mixing acceleration.

DETAILED DESCRIPTION OF THE PREFERRED EMBODIMENTS

Figure 1A:
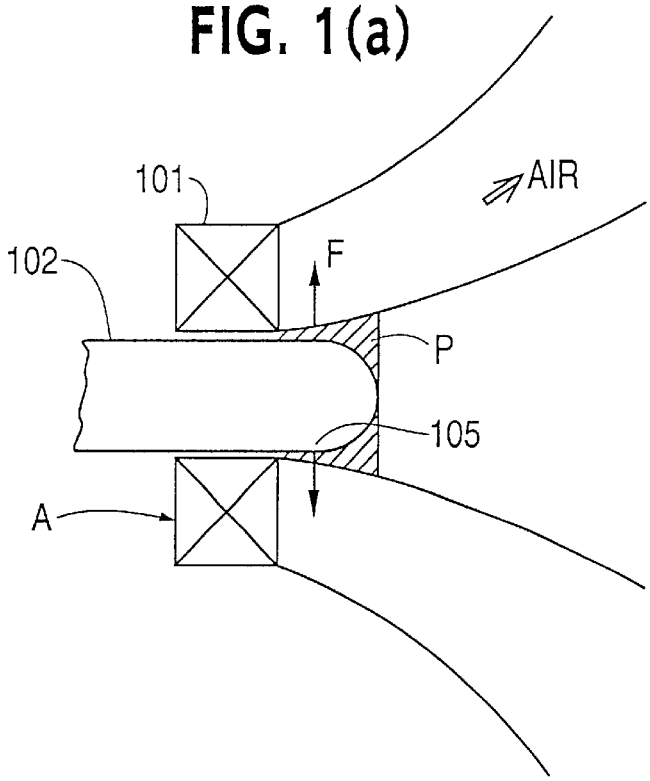
FIGS. 1(*a*)–(*c*) are views showing one embodiment according to the present invention, wherein FIG. 1(*a*) is a view showing an arrangement of a swirler relative to a fuel nozzle, FIG. 1(*b*) is a view showing an arrangement of swirler vanes, and FIG. 1(*c*) is a perspective view of one of the swirler vanes.
Figure 1B:
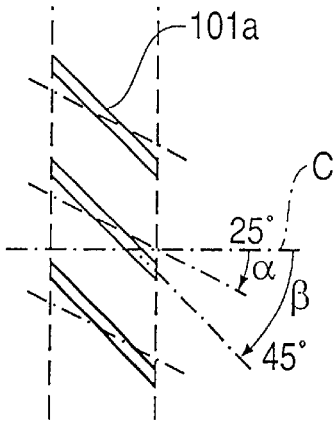
Figure 1C:
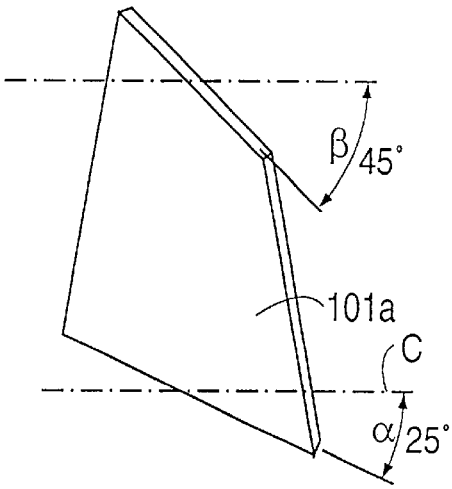
Figure 2A:
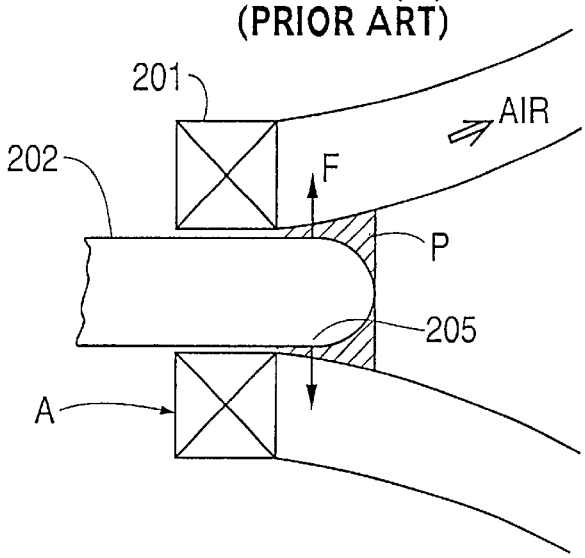
FIG. 2(a) (PRIOR ART)
FIGS. 2(*a*)–(*b*) are views of one example of a prior art swirler, wherein FIG. 2(*a*) is a view showing an arrangement of a swirler relative to a fuel nozzle, and FIG. 2(*b*) is a view showing an arrangement of swirler vanes.
Figure 2B:
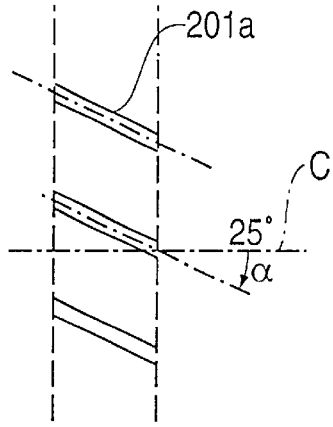
FIG. 2(b) (PRIOR ART)
Figure 3A:
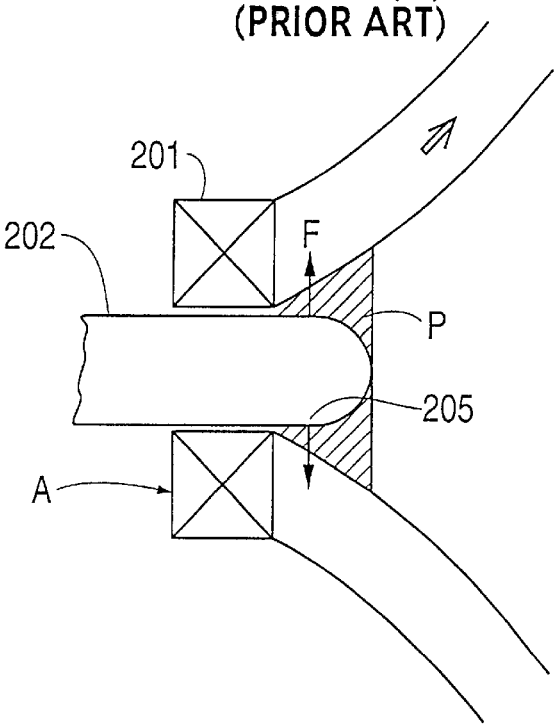
FIG. 3(a) (PRIOR ART)
FIGS. 3(*a*)–(*b*) are views of another example of a prior art swirler, wherein FIG. 3(*a*), is a view showing an arrangement of a swirler relative to a fuel nozzle, and FIG. 3(*b*) is a view showing an arrangement of swirler vanes.
Figure 3B:
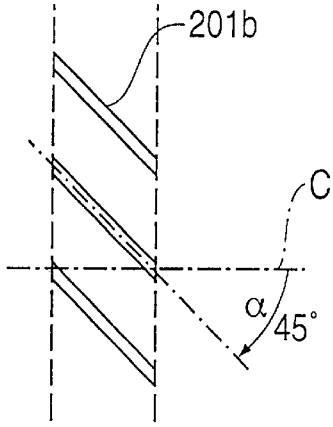
FIG. 3(b) (PRIOR ART)
Figure 4:
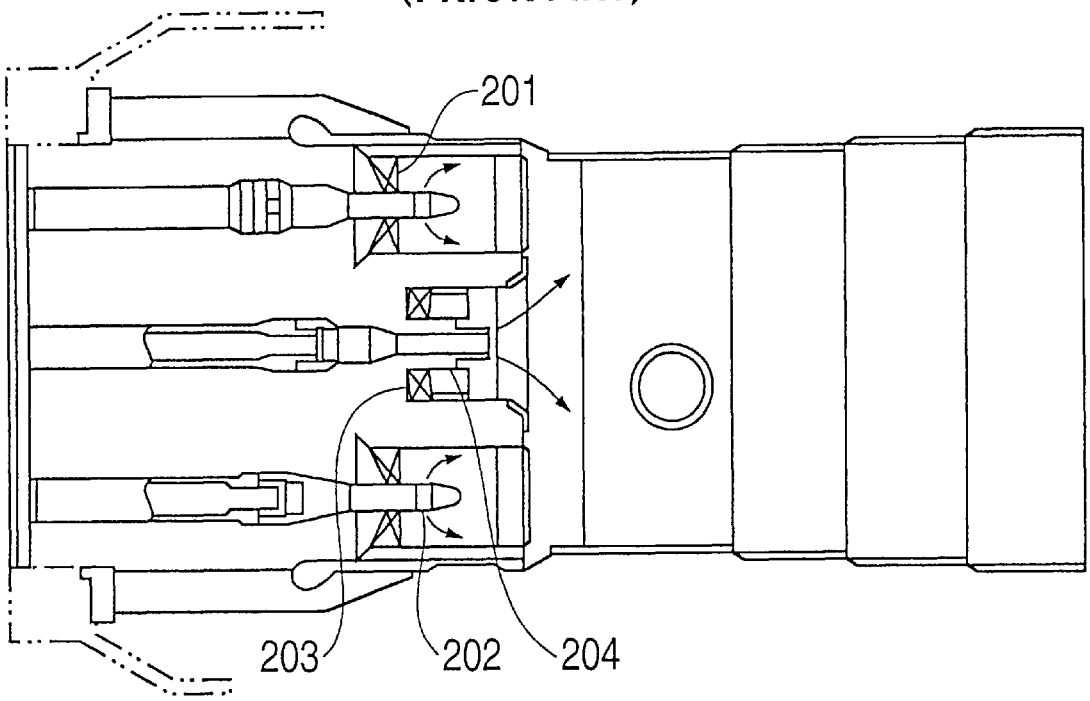
FIG. 4 (PRIOR ART)
FIG. 4 is an entire constructional view showing one example of a pre-mixed flame type low $NO_x$, combustor, which is known in the prior art.
Figure 5:
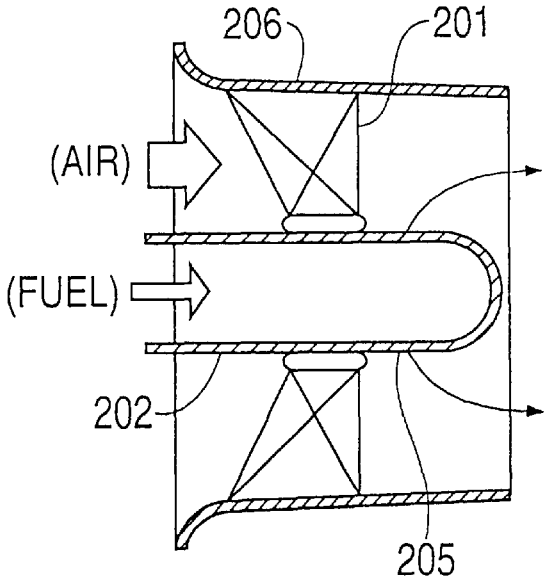
FIG. 5 (PRIOR ART)
FIG. 5 is a cross sectional view of a main fuel nozzle of the combustor of FIG. 4.

One embodiment according to the present invention will be described with reference to FIG. 1. FIGS. 1(*a*)–(*c*) show a three-dimensional swirler constructed in accordance with an embodiment of the present invention, wherein FIG. 1(*a*) shows an arrangement of a swirler relative to a fuel nozzle, FIG. 1(*b*) shows an arrangement of swirler vanes, and FIG. 1(*c*) is a perspective view of one of the swirler vanes.

In the present embodiment, a main swirler 101 is provided around a main fuel nozzle 102 and there are bored a plurality of nozzle holes 105 in a wall of the main fuel nozzle 102 along a circumferential direction thereof at position downstream of the main swirler 101, so that fuel F injected from the nozzle holes 105 mixes with air A which has passed through the main swirler 101 to form a so-called pre-mixture, and this basic concept and structure of the swirler is same as that of the described prior art swirler.

The present embodiment is featured in that the main swirler 101 is constructed in a specific form as follows.

That is, as shown in FIGS. 1(*b*) and (*c*), a fitting angle a of a swirler vane 101*a* on a hub side thereof is 25° relative to a center axis C of the main fuel nozzle 102 and a fitting angle β of the swirler vane 101*a* on a tip side thereof is 45° likewise relative to the center axis C of the main fuel nozzle 102.

Thus, as understood from FIG. 1(*c*), the swirler vane 101*a* is twisted from the hub side to the tip side by a differential angle between the hub side angle α=25° and the tip side angle β=45°.

In the present embodiment constructed as above, while the flow direction of the air A is changed of by the swirler vane 101*a* of the main swirler 101, because the fitting angle a on the hub side of the swirler vane 101*a* is 25°, a stagnation point P, if formed, at a tip portion of the main fuel nozzle 102 is not so large.

Also, the swirler vane 101*a* is twisted from the hub side to the tip side and the fitting angle β on the tip side of the swirler vane 101*a* is 45°, hence there can be formed a strong shear flow there.

Also, the fuel F of natural gas and the like is supplied into a swirling flow of the air A, via the nozzle holes 105 bored in the main fuel nozzle 102, and a pre-mixture of the fuel F and the air A is formed.

Thus, according to the present embodiment, the fitting angle on the hub side of the swirler vane 101*a* is set to 25° so that the stagnation point at the tip portion of the main fuel nozzle 102 is small and no substantial flame stagnation will occur there even if a back fire occurs, hence there is no fear that the components will be burned.

Also, the fitting angle on the tip side of the swirler vane 101*a* is set to 45° so that the shear flow of the air A on an outer side in a radial direction of the swirler is strong and mixing of the fuel F and the air A is accelerated, hence an excellent pre-mixture can be obtained.

The invention has been described with respect to the embodiment as illustrated, but it is not limited to such embodiment. Various modifications to the invention may made as come within the scope of the claims as set forth below.

What is claimed:

1. A gas turbine combustor comprising:

a pilot fuel nozzle adapted to form a flame portion in a central part of said gas turbine combustor;

a plurality of main fuel nozzles arranged so as to surround said pilot fuel nozzle for forming a pre-mixed gas of fuel and air, each of said plurality of main fuel nozzles comprising a cylindrical outer casing and a plurality of nozzle holes bored in said main fuel nozzle along a circumferential direction of said main fuel nozzle; and a plurality of swirlers, each of said swirlers being arranged to surround one of said plurality of main fuel nozzles and to extend to a position of said cylindrical outer casing, respectively, each of said plurality of swirlers comprising a hub fitted around said main fuel nozzle, and a plurality of swirler vanes fixedly connected to said hub and extending radially outward from said hub, each of said plurality of swirler vanes being twisted from a hub side thereof to a tip side thereof, wherein each of said plurality of swirler vanes has a fitting angle at said tip side of 45 degrees relative to a center axis of said main fuel nozzle, and a fitting angle at said hub side of 25 degrees relative to the center axis of said main fuel nozzle, wherein said plurality of nozzle holes of each of said plurality of main fuel nozzles is downstream of said swirler.

* * * * *